US006276336B1

(12) United States Patent
Krüger et al.

(10) Patent No.: US 6,276,336 B1
(45) Date of Patent: Aug. 21, 2001

(54) PRESSURE RESERVOIR FOR FUEL SUPPLY SYSTEMS

(75) Inventors: Hinrich Krüger, Regensburg; Christian Birkner, Irlbach; Klaus Rübling, Regensburg; Christoph Klesse, Pettendorf; Martin Werner, Hemau, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/182,283

(22) Filed: Oct. 29, 1998

(30) Foreign Application Priority Data

Oct. 29, 1997 (DE) ..... 197 47 736

(51) Int. Cl.[7] ..... F02M 37/04
(52) U.S. Cl. ..... 123/456; 123/468
(58) Field of Search ..... 123/468, 469, 123/470, 456, 447, 452

(56) References Cited

U.S. PATENT DOCUMENTS

| | | | | |
|---|---|---|---|---|
| 2,937,636 | * | 5/1960 | Aldinger | 123/452 |
| 3,077,872 | * | 2/1963 | Allen | 123/447 |
| 3,783,842 | * | 1/1974 | Kuhn | 123/469 |
| 4,653,528 | * | 3/1987 | Field | 123/468 |
| 5,156,134 | * | 10/1992 | Tochizawa | 123/469 |
| 5,186,147 | * | 2/1993 | Bellis | 123/452 |
| 5,443,046 | * | 8/1995 | White | 123/497 |
| 5,511,527 | | 4/1996 | Lorraine et al. . | |
| 5,666,922 | * | 9/1997 | Krimmer | 123/469 |

FOREIGN PATENT DOCUMENTS

| | | | |
|---|---|---|---|
| 39 32 672 A1 | | 4/1990 | (DE) . |
| 41 35 292 A2 | | 5/1992 | (DE) . |
| 195 31 743 C1 | | 12/1996 | (DE) . |
| 195 32 599 A1 | | 4/1997 | (DE) . |
| 0 625 627 A1 | | 11/1994 | (EP) . |
| 404311670 | * | 11/1992 | (JP) ..... 123/468 |

* cited by examiner

*Primary Examiner*—Carl S. Miller
(74) *Attorney, Agent, or Firm*—Herbert L. Lerner; Laurence A. Greenberg; Werner H. Stemer

(57) ABSTRACT

A pressure reserve for a common rail fuel supply system has outlet connections communicating with injection valves. The outlet connections are disposed in end pieces connected to an elongated hollow body. This disposition of the outlet connections assures that pressure surges that occur in the pressure reservoir have only a very slight influence on the injection events. In addition, economical production of the pressure reservoir is possible.

14 Claims, 6 Drawing Sheets

PRESSURE RESERVOIR FOR FUEL SUPPLY SYSTEMS

BACKGROUND OF THE INVENTION

Field of the Invention

The invention relates to a pressure reservoir for a fuel supply system. The pressure reservoir is formed of an elongated hollow body with an inlet connection for communicating with a high-pressure pump and at least two outlet connections for communicating with injection valves.

Such pressure reservoirs are used above all in injection systems known by the name "common rail", which makes it possible to keep the injection pressure and the injection quantity independent of the engine speed, and moreover to increase the injection pressure to above 1500 bar. In the common rail injection systems, fuel is pumped by a high-pressure pump out of a tank into the pressure reservoir, by way of which the fuel is present at injection valves that are each disposed in the cylinder heads of an engine. The pressure reservoir is generally tubular in shape and oriented parallel to the cylinder heads. The outlet connections for the injection valves disposed in the cylinder heads are generally disposed along the tubular body in a spacing equivalent to the spacings between individual injection valves.

The injection events into the cylinders are tripped by supplying current to the appropriate injection valves. The injection volume depends on the pressure prevailing at the injection valves and on the duration of the supply of electrical current. The injection events performed by the injection valves cause pressure fluctuations in the pressure reservoir. However, because of the position of the outlet connections that are distributed over the length of the tubular body, a variable effect on the individual injection valves and on the injection events performed by these injection valves can occur, and in particular can lead to variations in the respective injection volume.

To prevent such disadvantageous pressure fluctuations in the pressure reservoir that are tripped by the injection events, it is known from Published, Non-Prosecuted German Patent Application DE 195 32 599 A1 to divide the pressure reservoir into two individual reservoirs. In the application, each reservoir communicates with the common high-pressure pump via a respective distributor element. The individual reservoirs are then loaded in accordance with the ignition sequence of the engine, thus assuring that for the successive injection events, an unloaded individual reservoir will be available, and thus the pressure fluctuations tripped by one injection event cannot affect the next injection event. However, the embodiment involves increased production and installation expense, because both two pressure reservoirs and an additional distributor element have to be manufactured and installed in the engine compartment.

Furthermore, as in the conventional tubular pressure reservoirs, the outlet connections assigned to the various injection valves in the individual reservoirs used in Published, Non-Prosecuted German Patent Application DE 195 32 599 A1 are disposed along the tubular body. However, since in the region of the outlet connections the material load resulting from the internal pressure in the pressure reservoir is multiplied, the wall thickness and material strength in the region of the outlet connections must be oversized considerably compared with the other regions. This leads to both a high weight of the pressure reservoir and high costs for materials. Moreover, autofrettage is as a rule necessary as well.

SUMMARY OF THE INVENTION

It is accordingly an object of the invention to provide a pressure reservoir for fuel supply systems, which overcomes the above-mentioned disadvantages of the prior art devices of this general type, which is favorable in terms of production costs and reliably prevents changes in the outflow volume to the individual injection valve connections that might be tripped by pressure fluctuations resulting from the injection events.

With the foregoing and other objects in view there is provided, in accordance with the invention, a pressure reservoir for a fuel supply system, including: an elongated hollow body having ends and an inlet connection for communicating with a high-pressure pump; and at least one end piece having at least two outlet connections for communicating with injection valves and disposed on at least one of the ends of the elongated hollow body, the at least two outlet connections disposed symmetrically about the elongated hollow body.

In the pressure reservoir of the invention, the outlet connections to the injection valves are disposed on the ends of the elongated hollow body that forms the pressure reservoir. In this manner, all of the outlet connections to the injection valves are subject to the same conditions with regard to possible pressure fluctuations in the pressure reservoir, and different outflow volumes are thus avoided. Moreover, by disposing the outlet connections in the region of the end portions of the pressure reservoir, a reduction in material costs can be achieved, since increased material loads occur not in the region of the circumferential wall of the hollow body but rather only in the region of outlet connections.

In accordance with an added feature of the invention, each of the at least two outlet connections have an axis and the elongated hollow body has an axis, the axis through each of the at least two outlet connections is inclined relative to the axis of the elongated hollow body.

In accordance with an additional feature of the invention, each of the at least two outlet connections have an axis and the elongated hollow body has an axis, the axis through each of the at least two outlet connections is laterally offset relative to the axis of the elongated hollow body.

In accordance with another feature of the invention, the at least one end piece has a tapered shape with a jacket face, and the at least two outlet connections are embodied on the jacket face.

In accordance with a further added feature of the invention, the at least one end piece includes a first end piece and a second end piece disposed respectively on the ends of the elongated hollow body, the first end piece and the second end piece each have at least one of the at least two outlet connections disposed thereon, and the at least two outlet connections disposed on the first end piece and the second end piece are recessed in mirror symmetry to one another.

In accordance with a further additional feature of the invention, there is a pressure sensor, and the elongated hollow body has a middle part and the pressure sensor and the inlet connection are embodied on the middle part.

In accordance with yet another feature of the invention, the injection valves have lines each with a diameter to be connected to the at least two outlet connections, and the at least two outlet connections each have a diameter larger than the diameter of the lines.

In accordance with yet another added feature of the invention, one of the ends of the elongated hollow body has an inside cone and the at least one end piece has an outside cone, a sealing point is created between the inside cone and the outside cone if the outside cone of the at least one end piece is screwed into the inside cone of the elongated hollow body.

In accordance with yet another additional features of the invention, the one end of the elongated hollow body and the at least one end piece each have male threads embodied in a same direction each with a thread pitch, and including a nut receiving the male threads for bracing the elongated hollow body against the at least one end piece, and the thread pitch of the at least one end piece is greater than the thread pitch of the one end of the elongated hollow body.

In accordance with a concomitant feature of the invention, there is a sealing element having two outside cones, one of the ends of the elongated hollow body and the at least one end piece each have an inside cone for receiving one of the two outside cones, the sealing element disposed between the one of the ends of the elongated hollow body and the at least one end piece forming sealing points between each of the two outside cones and the inside cone of the at least one end piece and the inside cone of the one of the ends of the elongated hollow body, respectively, when the at least one end piece is screwed onto the elongated hollow body.

With the foregoing and other objects in view there is also provided, in accordance with the invention, in combination with an engine having a block of in-line cylinders with cylinder heads, injection valves, and a high-pressure pump, a pressure reservoir including: an elongated hollow body having ends and an inlet connection for communicating with the high-pressure pump; a first end piece having at least one outlet connection for communicating with the injection valves and disposed symmetrically about the elongated hollow body on one of the ends; a second end piece having at least one outlet connection for communicating with the injection valves and disposed symmetrically about the elongated hollow body on another of the ends, the at least one outlet connection of the first end piece recessed in mirror symmetry to the at least one outlet connection of the second end piece; the elongated hollow body with the first end piece and the second end piece defining a given length; and the elongated hollow body oriented parallel to the cylinder heads, and the given length substantially equivalent to half a number of cylinders times a cylinder spacing.

With the foregoing and other objects in view there is further provided, in accordance with the invention, in combination with an engine having two blocks of cylinders with cylinder heads, injection valves, and a high-pressure pump, a pressure reservoir including: an elongated hollow body having ends and an inlet connection for communicating with the high-pressure pump; a first end piece having at least one outlet connection for communicating with the injection valves and disposed symmetrically about the elongated hollow body on one of the ends; a second end piece having at least one outlet connection for communicating with the injection valves and disposed symmetrically about the elongated hollow body on another of the ends, the at least one outlet connection of the first end piece recessed in mirror symmetry to the at least one outlet connection of the second end piece; and the elongated hollow body is disposed centrally crosswise to the engine, and the first end piece and the second end piece each end above a respective one of the cylinder heads of one of the two cylinder blocks of the engine.

Other features which are considered as characteristic for the invention arc set forth in the appended claims.

Although the invention is illustrated and described herein as embodied in a pressure reservoir for fuel supply systems, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
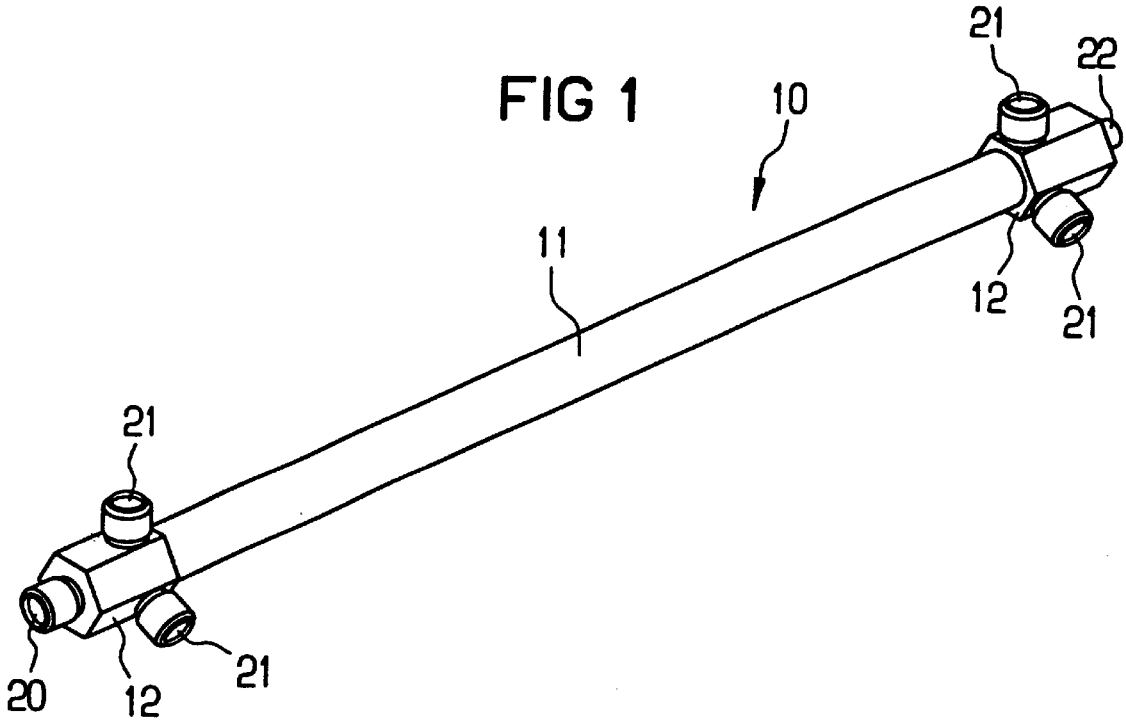
FIG. 1 is a perspective view of a pressure reservoir in accordance with a first exemplary embodiment according to the invention.

In all the figures of the drawing, sub-features and integral parts that correspond to one another bear the same reference symbol in each case. Referring now to the figures of the drawing in detail and first, particularly, to FIG. 1 thereof, there is shown a first embodiment of a pressure reservoir 10 according to the invention. The first embodiment has a tubular hollow body 11 to both ends of which hexagonal attachments 12 are attached. Neck-like outlet connections 21, to which injection valves can be connected, are mounted on the side faces of the hexagonal attachments 12. The outlet connections 21 on the attachments 12 are disposed in mirror symmetry to a center plane at right angles to the axis through the tubular hollow body 11 of the pressure reservoir. An inlet connection 20 is also mounted on the end face of one of the attachments 12 and can be connected to a high-pressure pump for supplying the pressure reservoir with fuel. The axis through the inlet connection 20 preferably coincides with the axis of the tubular hollow body 11, which makes for a favorable disposition of the fuel supply line to the pressure reservoir in an engine compartment and for simple supply of fuel to the tubular hollow body. In mirror symmetry with the inlet connection 20, a pressure sensor 22 is disposed on the other end face of the other attachment 12, and by way of the sensor 22 the pressure in the pressure reservoir 10 can be determined. The pressure ascertained can be sent to an electronic control unit, which triggers the injection valves and the high-pressure pump.

Figure 2:
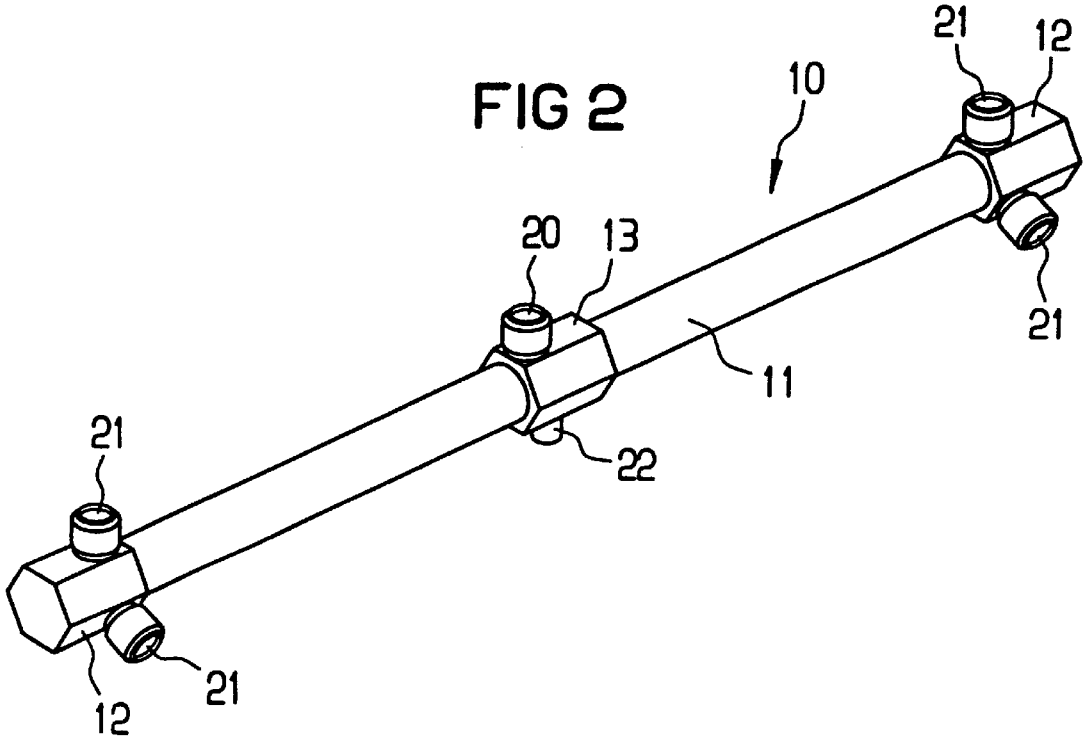
FIG. 2 is a perspective view of the pressure reservoir in accordance with a second exemplary embodiment.

As an alternative to the embodiment shown in FIG. 1, it is possible, as shown in FIG. 2, for the tubular hollow body 11 to be provided with an adapter 13 in the middle. The adapter 13 is preferably also hexagonal, and on which the inlet connection 20 and the pressure sensor 22 are disposed.

In a modification of the embodiment shown in FIG. 1, it is also possible for only one of the arrangements 12 to be equipped with the outlet connections 21, while the other attachment has only the inlet connection 20 or the pressure sensor 22 as well. It is thus possible to adapt the configuration of the pressure reservoir 10 to the spatial conditions prevailing in the engine compartment. However, it is essential that the outlet connections 21 are disposed in the end regions of the pressure reservoir 10 and geometrically identically with respect to the tubular hollow body 11. This configuration assures that pressure fluctuations tripped in the pressure reservoir 10 by the injection events of the injection valves connected to the outlet connections 21 will not cause any differences in the outflow volumes of the individual outlet connections 21, since all the outlet connections are spatially subject to the same conditions with regard to the pressure fluctuations. The embodiment shown in FIG. 2, in which the inlet connection 20 is disposed in the middle of the pressure reservoir 10, also assures an increase in the uniformity of the pressure prevailing in the pressure reservoir 10. The amplitude of the high-frequency pressure fluctuations in the pressure reservoir 10 that are tripped by the injection events can be still further reduced if the inside diameters of the outlet connections 21 are made greater than the inside diameters of the supply lines connected to them, leading to the injection valves.

Since in the region of the outlet connections 21, the material load resulting from the internal pressure of the pressure reservoir 10 undergoes multiplication, it is necessary for the regions to be embodied with greater wall thicknesses and/or stronger materials, to suit the increased material load. By limiting the outlet connections 21 to the end regions of the pressure reservoir 10, as provided by the invention, the additional material and productions costs can be reduced to a minimum. In addition, autofrettage can also be dispensed with.

Figure 3A:
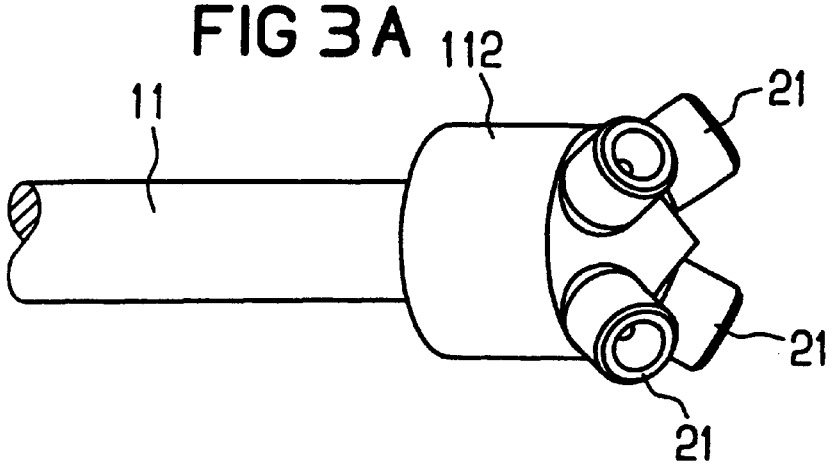
FIGS. 3A–3C are fragmentary, perspective views of various dispositions of outlet connections on the pressure reservoir.
Figure 3B:
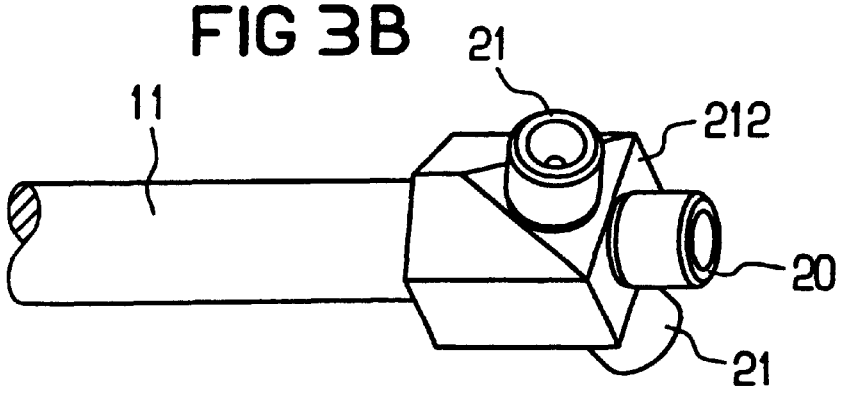
Figure 3C:
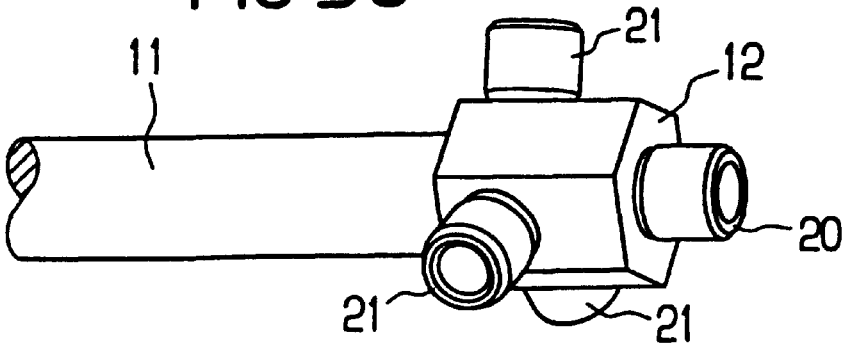

FIGS. 3A–3C show especially favorable dispositions of the outlet connections 21 on the attachment 12 mounted on the tubular hollow body 11. FIG. 3*c* shows essentially the same configuration of the outlet connections 21 on a hexagonal attachment 12 as has already been shown in FIGS. 1 and 2. The outlet connections 21 are disposed in a star pattern relative to one another on the side faces of the attachment 12 and axes of the outlet connections 21 are perpendicular to the axis of the tubular hollow body 11. The inlet connection 20 is mounted on the end face, oriented perpendicular to the hollow body 11, of the attachment 12, in alignment with its axis. This embodiment is distinguished by especially simple production of the attachment 12 and of the outlet connections 21.

Alternatively, as shown in FIG. 3*a*, an attachment 112 may also be embodied in the form of a short tube with a cone mounted on it; the outlet connections 21 are mounted rotationally symmetrically on the jacket face of the cone. This configuration makes it possible to reduce the requisite wall thicknesses and material strength values for the attachment 112 and thus to reduce the production costs. This is possible since the inner bores in the outlet connections 21 meet in the end face of the tubular hollow body 11, which is accordingly a region that is under compressive strain because of the internal pressure prevailing in the pressure reservoir 10. However, the compressive strain dictates a lesser material load for the outlet connections 21, compared with outlet connections 21 that open into the circumferential wall of the hollow body and are thus subject to a tensile strain because of the internal pressure in the pressure reservoir 10.

In a further embodiment, shown in FIG. 3B, an attachment 212 has faces which converge obliquely on its end face and in which the outlet connections 21 are disposed rotationally symmetrically about the axis through the hollow body 11. This embodiment has the same advantages as that shown in FIG. 3A, but it is simpler to produce and is especially suitable whenever only a small number of outlet connections 21 are to be disposed on the attachment 212.

Figure 4A:
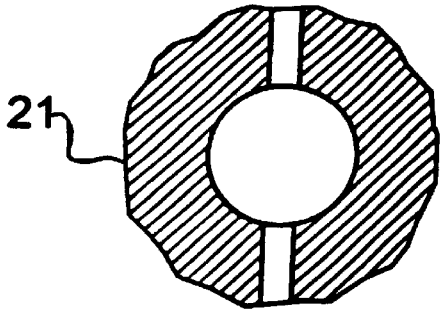
FIGS. 4A–4C are sectional views through end portions of the pressure reservoir.
Figure 4B:
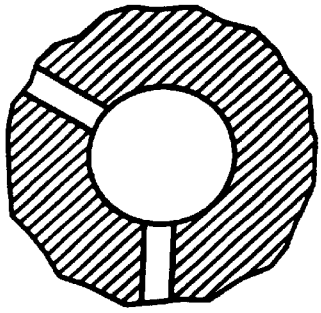
Figure 4C:
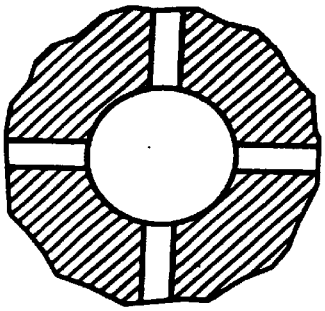
Figure 5A:
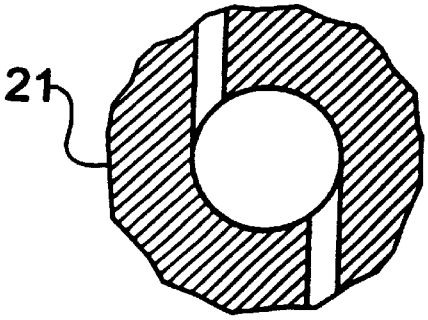
FIGS. 5A–5D are sectional views through end portions of the pressure reservoir.
Figure 5B:
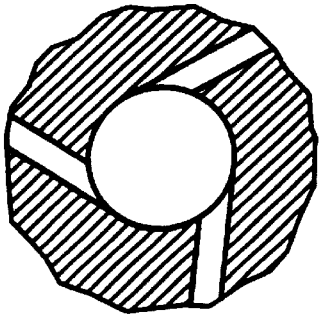
Figure 5C:
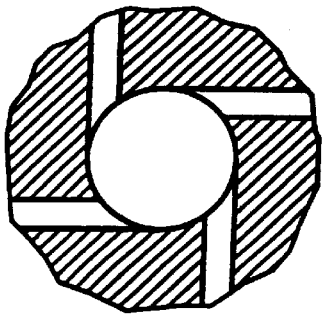
Figure 5D:
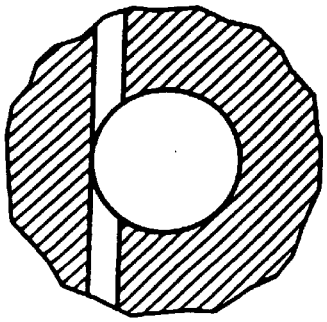

For production reasons, it is especially favorable if, as shown in FIGS. 4A–4C, that the bores of the outlet connections 21 are disposed radially to the inner bore of the attachment. To increase the strength of the outlet connections 21 in the attachment, it is also possible, however, as shown alternatively for various embodiments in FIGS. 5A–5D, for the inner bores of the outlet connections 21 to be laterally offset from the axis through the attachment.

Figure 6A:
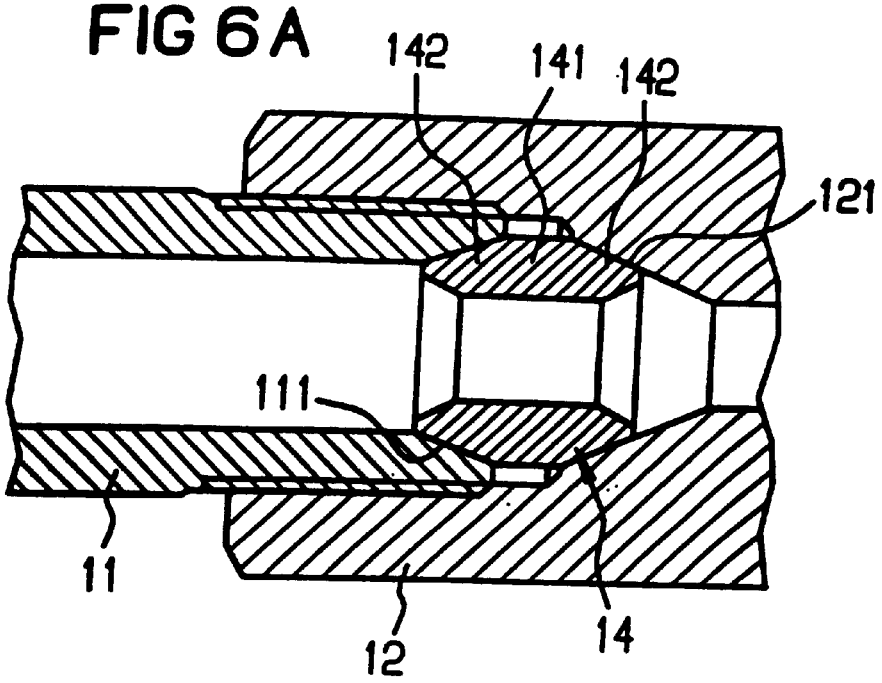
FIGS. 6A and 6B are longitudinal sectional views through the end portions of the pressure reservoir.
Figure 6B:
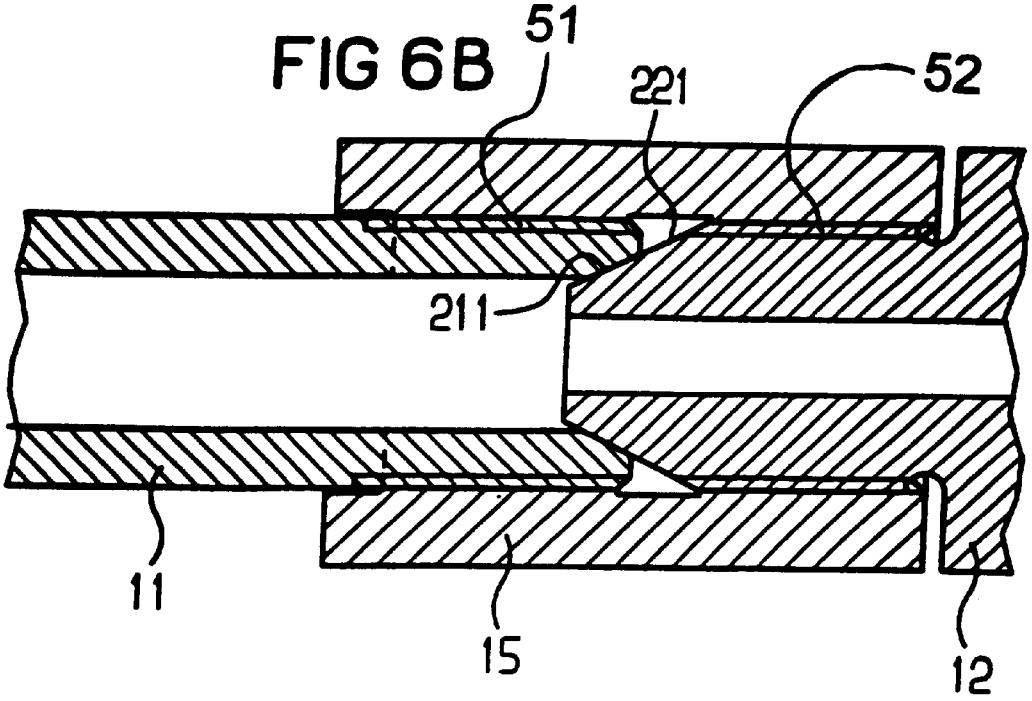

The tubular hollow body 11 of the pressure reservoir 10 is generally formed by boring into rod material, or is already made in the form of a drawn tube. The form of a hollow body 11 can then be adapted to suit the space available in the engine compartment. The attachments 12, 112, 212 on the ends of the hollow body 11 may be mounted by friction welding, laser welding, or electric steel welding. However, there is also the possibility, which is often simpler from a production standpoint, of screwing the attachments 12, 112, 212 onto the ends of the hollow body 11, as shown in FIGS. 6A and 6B. In that case, though, it is often difficult to assure that the attachments 12, 112, 212 and the outlet connections 21 disposed on them will be in the correct angular position for installation of the pressure reservoir 10 in the engine compartment.

In the embodiment shown in FIG. 6A, the hollow body 11 is provided in its end portion with a male thread, onto which a female thread provided in the attachment 12 is screwed. For sealing off the screw connection, a sealing element 14 is disposed between the hollow body 11 and the attachment 12. The sealing element 14 has a continuous inner bore, which connects the interior of the hollow body 11 with the inner bore of the attachment 12. The sealing element 14 is composed of two truncated cones 142, joined together via a middle piece 141, which are each adapted to inside cones 111, 121 embodied in the hollow body 11 and in the attachment 12, respectively. When the attachment 12 is screwed onto the hollow body 11, the attachment 12 is tightened up to a prescribed minimum torque, which assures adequate sealing of the screw connection, and is then tightened further until the desired angular position of the attachment 12 with the outlet connections 21 is attained. The conical configuration of the sealing element 14, and the inside cones 111, 121 to suit in the hollow body 11 and the attachment 12 assure that the material loads resulting from the tightening moments will not become excessive. It is also advantageous to make the cone angles of the sealing element 14 more acute than the cone angles of the inside cones 111, 121 of the hollow body 11 and attachment 12, so as to assure a sealing point of the least possible diameter between the sealing element 14 and the attachment 12 or the hollow body 11, as applicable. The cone angles are preferably in a range from 30 to 60. It is also advantageous to make the sealing element 14 from a material that is softer than that of the attachment 12 and the hollow body 11, so as to assure that when the attachment 12 is tightened onto the hollow body 11, only the sealing element 14 will be deformed. For screwing together the attachment 12 and the hollow body 11, thread pitches of 0.1 to 1.5 mm have proved to be advantageous, and using a male thread on the hollow body 11 has the advantage of averting soiling of the interior of the hollow body 11 as it is being screwed on.

In a further embodiment, shown in FIG. 6B, however, a screw connection between the hollow body 11 and the attachment 12 can also be made without using a sealing element. In this embodiment, the end portion of the hollow body 11 and the adjacent portion of the attachment 12 are each provided with male threads 51, 52 onto which the female thread of a nut 15 can be screwed. The two male threads 51, 52 can be embodied in contrary directions or in the same direction with different pitches; with threads of the same direction the thread pitch on the end portion of the hollow body 11 is always made greater than the thread pitch on the attachment 12. The use of threads with the same direction has the advantage over contrary threads of less-expensive manufacture. For threads in the same direction, the relative motion of the hollow body 11 and the attachment 12 to one another is also determined by the difference between the two thread pitches, so that the motion between the attachment 12 and the hollow body 11 is stepped down. This increases the tightening force when the attachment 12 and the hollow body 11 are screwed together via the nut 15 and thus makes assembly easier. In contrast, contrary thread versions have the effect that the thread pitches are added together in the relative motion of the hollow body 11 and the attachment 12, and thus a greater tightening moment is needed to an achieve equal contact-pressure and sealing force, in comparison with a thread constructed in the same direction.

To attain better sealing off of the screw connection, the hollow body 11 is provided with an inside cone 211, which is engaged by an outside cone 221 on the attachment 12. To screw the attachment 12 onto the hollow body 11, the attachment 12 is first screwed into the nut 15, until the nut 15 rests on a stop on the attachment 12. Then the two parts are screwed together onto the hollow body 11, until the outside cone 221 of the attachment 12 reaches the inside cone 211 of the hollow body 11. Next, the nut 15 and the attachment 12 are unscrewed jointly far enough that the attachment 12 is in the desired angular position to the outlet connections. The attachment 12 is then held in this position and the nut 15 is tightened up to the prescribed torque, so that adequate sealing of the screw connection is attained.

In FIGS. 7–10, dispositions of the pressure reservoir 10 according to the invention for various engine constructions are shown.

Figure 7:
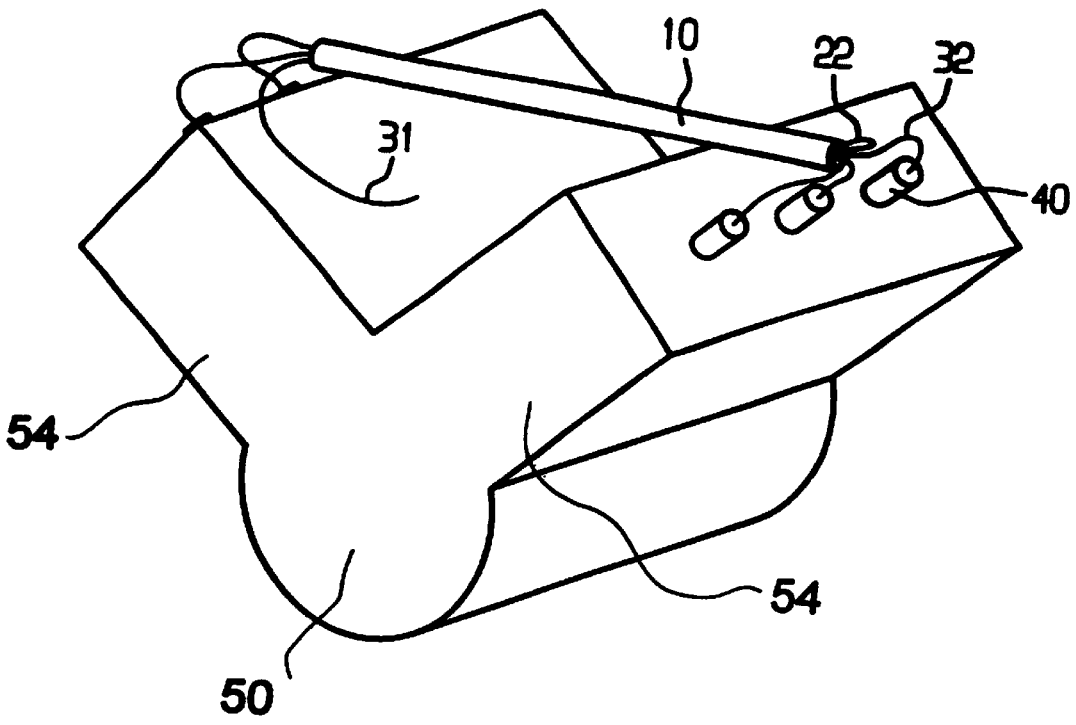
FIG. 7 is a perspective view of a disposition of the pressure reservoir in a V-6 engine.
Figure 8:
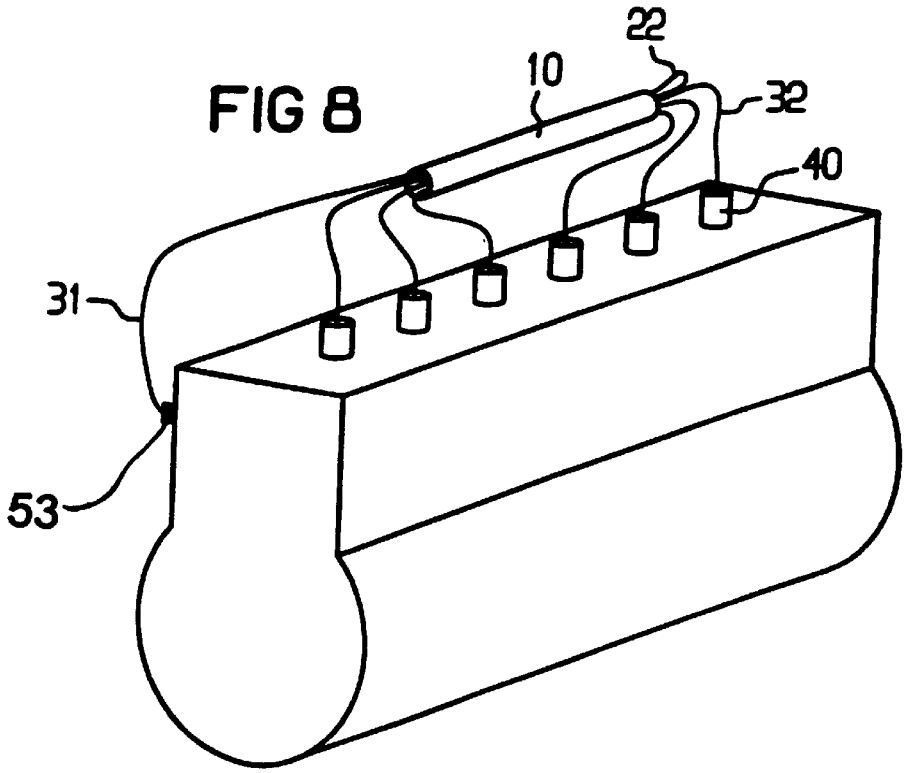
FIG. 8 is a perspective view of the disposition of the pressure reservoir in an in-line, six-cylinder engine.

FIG. 7 shows a V-6 engine 50 with two cylinder blocks 54, in which the pressure reservoir 10 is disposed in the middle, transversely to an engine 50, and extends essentially between the two middle cylinder heads. The outlet connections 21 disposed on the ends of the pressure reservoir 10 are connected via lines 32 to the injection valves 40 in the cylinder heads. Fuel is fed into the pressure reservoir 10 via a further supply line 31 coupled to a high-pressure pump 53 (FIG. 8). The injection sequence in the V-6 shown is selected such that in each case alternatingly via the two ends of the pressure reservoir 10, fuel is supplied to the appropriate injection valve 40. This assures that identical conditions with respect to pressure fluctuations occurring in the pressure reservoir 10 prevail at all the outlet connections 21 of the pressure reservoir 10, and thus that all the cylinders are supplied with the same injection volume. The pressure reservoir 10 configuration shown in FIG. 7 is essentially suitable for all V-type and boxer-type engine configurations.

FIG. 8 shows the pressure reservoir 10 configuration in an in-line six-cylinder engine, in which the pressure reservoir 10 is disposed parallel to the cylinder heads. The length of the pressure reservoir 10 is advantageously selected such that it is approximately half the number of cylinders times the axial spacing between individual cylinders of the engine. The injection sequence in the in-line engine shown in FIG. 8 is advantageously selected such that in each case in alternation, fuel is supplied to the applicable injection valve first via one and then via the other side of the pressure reservoir 10. In a way similar to the embodiment shown in FIG. 7, this assures that all the cylinders are supplied with the same injection volume. The embodiment shown in FIG. 8 is essentially suitable for all in-line engine configurations.

Figure 9:
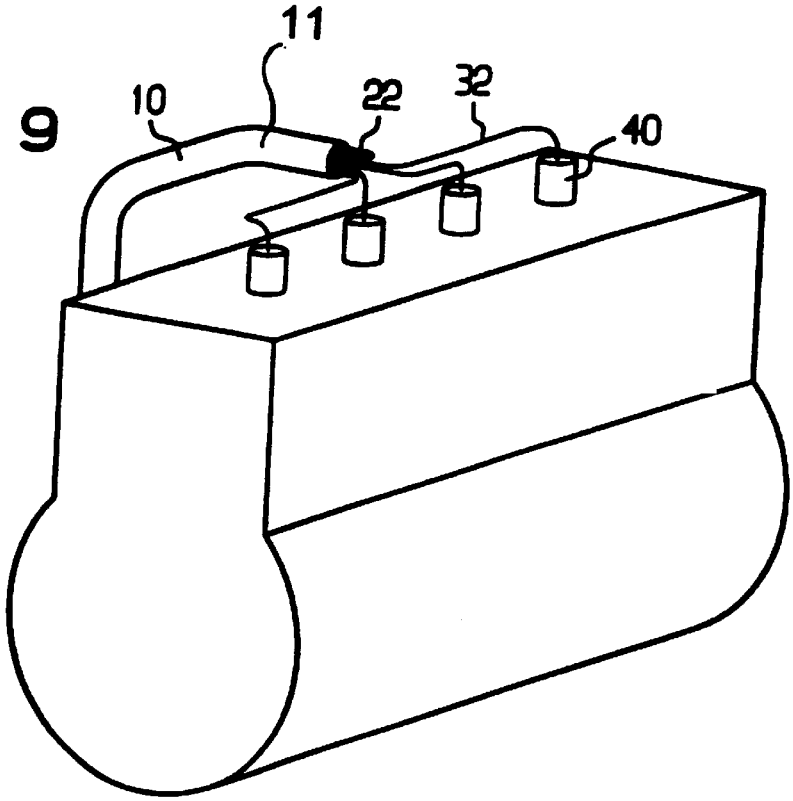
FIG. 9 is a perspective view of the disposition of the pressure reservoir in an in-line, four-cylinder engine.

FIG. 9 shows a further possible pressure reservoir 10 configuration, which proves to be favorable particularly for two, three and four-cylinder in-line engines. The tubular hollow body 11 of the pressure reservoir 10 is embodied in curved fashion and is disposed with one end on the high-pressure pump. The other end of the pressure reservoir 10 is located essentially in the middle above a cylinder head of the engine.

Figure 10:
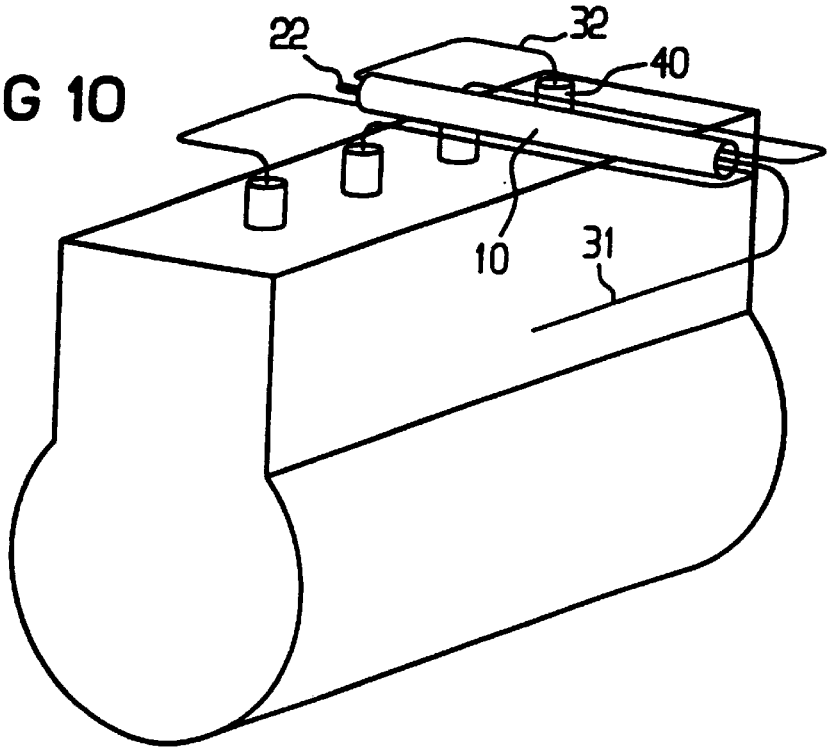
FIG. 10 is a perspective view of a further disposition of the pressure reservoir in the in-line, four-cylinder engine.

FIG. 10 shows another pressure reservoir 10 configuration, in which the pressure reservoir 10 is disposed crosswise and in the middle with respect to an in-line four-cylinder engine. The injection valves of the inner cylinders are connected to one end of the pressure reservoir 10, while the injection valves of the outer cylinders are connected to another end of the pressure reservoir 10. The injection volumes for the cylinders can thus be supplied via the two ends of the pressure reservoir 10 in alternation.

We claim:

1. In combination with an engine having a block of in-line cylinders with cylinder heads, injection valves, and a high-pressure pump, a pressure reservoir comprising:

an elongated hollow body having ends and an inlet connection for communicating with the high-pressure pump;

a first end piece having at least one outlet connection for communicating with the injection valves and disposed symmetrically about said elongated hollow body on one of said ends;

a second end piece having at least one outlet connection for communicating with the injection valves and disposed symmetrically about said elongated hollow body on another of said ends, said at least one outlet connection of said first end piece recessed in mirror symmetry to said at least one outlet connection of said second end piece;

said elongated hollow body with said first end piece and said second end piece defining a given length; and said elongated hollow body oriented parallel to the cylinder heads, and said given length substantially equivalent to half a number of cylinders times a cylinder spacing.

2. In combination with an engine having two blocks of cylinders with cylinder heads, injection valves, and a high-pressure pump, a pressure reservoir comprising:

an elongated hollow body having ends and an inlet connection for communicating with the high-pressure pump;

a first end piece having at least one outlet connection for communicating with the injection valves and disposed symmetrically about said elongated hollow body on one of said ends;

a second end piece having at least one outlet connection for communicating with the injection valves and disposed symmetrically about said elongated hollow body on another of said ends, said at least one outlet connection of said first end piece recessed in mirror symmetry to said at least one outlet connection of said second end piece; and said elongated hollow body is disposed centrally crosswise to the engine, and said first end piece and said second end piece each end above a respective one of the cylinder heads of one of the two cylinder blocks of the engine.

3. A high pressure reservoir for a common rail fuel injection system having a high-pressure pump and fuel injection valves, the pressure reservoir comprising:

an elongated hollow body having ends and an inlet connection for communicating with a high-pressure pump of a fuel injection system; and at least one end piece having at least two outlet connections for communicating with fuel injection valves and disposed on at least one of said ends of said elongated hollow body, said at least two outlet connections disposed symmetrically about said elongated hollow body.

4. The pressure reservoir according to claim 3, wherein each of said at least two outlet connections have an axis and said elongated hollow body has an axis, said axis through each of said at least two outlet connections is inclined relative to said axis of said elongated hollow body.

5. The pressure reservoir according to claim 3, wherein each of said at least two outlet connections have an axis and said elongated hollow body has an axis, said axis through each of said at least two outlet connections is laterally offset relative to said axis of said elongated hollow body.

6. The pressure reservoir according to claim 3, wherein said at least one end piece has a tapered shape with a jacket face, and said at least two outlet connections are embodied on said jacket face.

7. The pressure reservoir according to claim 3, wherein said at least one end piece includes a first end piece and a second end piece disposed respectively on said ends of said elongated hollow body, said first end piece and said second end piece each have at least one of said at least two outlet connections disposed thereon, and said at least two outlet connections disposed on said first end piece and said second end piece are recessed in mirror symmetry to one another.

8. The pressure reservoir according to claim 3, wherein said elongated hollow body has a middle part and said inlet connection is embodied on said middle part.

9. The pressure reservoir according to claim 3, wherein said elongated hollow body has a middle part, and including a pressure sensor embodied on said middle part.

10. The pressure reservoir according to claim 3, including a pressure sensor, and said elongated hollow body has a middle part and said pressure sensor and said inlet connection are embodied on said middle part.

11. The pressure reservoir according to claim 3, wherein the injection valves have lines each with a diameter to be connected to said at least two outlet connections, and said at least two outlet connections each have a diameter larger than the diameter of the lines.

12. The pressure reservoir according to claim 3, wherein one of said ends of said elongated hollow body has an inside cone and said at least one end piece has an outside cone, a sealing point is created between said inside cone and said outside cone if said outside cone of said at least one end piece is screwed into said inside cone of said elongated hollow body.

13. The pressure reservoir according to claim 12, wherein said one end of said ends of said elongated hollow body and said at least one end piece each have male threads embodied in a same direction each with a thread pitch, and including a nut receiving said male threads for bracing said elongated hollow body against said at least one end piece, and said thread pitch of said at least one end piece is greater than said thread pitch of said one end of said elongated hollow body.

14. The pressure reservoir according to claim 3, including a sealing element having two outside cones, one of said ends of said elongated hollow body and said at least one end piece each have an inside cone for receiving one of said two outside cones, said sealing element disposed between said one of said ends of said elongated hollow body and said at least one end piece forming sealing points between each of said two outside cones and said inside cone of said at least one end piece and said inside cone of said one of said ends of said elongated hollow body, respectively, when said at least one end piece is screwed onto said elongated hollow body.

* * * * *